US006325173B1

(12) United States Patent
Miller

(10) Patent No.: US 6,325,173 B1
(45) Date of Patent: Dec. 4, 2001

(54) EAR WIND SHIELD

(76) Inventor: William B. Miller, P.O. Box 6236, Woodland Park, CO (US) 80866

( * ) Notice: Subject to any disclaimer, the term of this patent is extended or adjusted under 35 U.S.C. 154(b) by 0 days.

(21) Appl. No.: 09/419,502

(22) Filed: Oct. 18, 1999

(51) Int. Cl.[7] ..... H04R 25/00

(52) U.S. Cl. ..... 181/136; 181/133

(58) Field of Search ..... 181/133, 136, 181/129

(56) References Cited

U.S. PATENT DOCUMENTS 4,437,538 * 3/1984 Ohlsson et al. ..... 181/129
4,944,361 * 7/1990 Lindgren et al. ..... 181/129
5,148,887 * 9/1992 Murphy ..... 181/129
5,691,514 * 11/1997 Landis ..... 181/129
5,691,515 * 11/1997 Landis ..... 181/129

* cited by examiner

*Primary Examiner*—Robert E. Nappi
*Assistant Examiner*—Kim Lockett
(74) *Attorney, Agent, or Firm*—G. F. Gallinger

(57) ABSTRACT

A method of alleviating the sound masking effects of wind noise on a cyclist wearing a safety helmet comprising the following steps: designing an ear cover shield having a generally smooth exterior side; positioning the cover shield adjacent to but generally spaced from an ear of the cyclist so that wind is generally deflected from the ear so that the noise of air rushing over the ear is substantially reduced, and the cyclist is better able to hear proximate sound especially that sound generated from directions which he cannot readily see; and, positioning and holding the cover shield adjacent to the ear most preferably by adjustably attaching it to a strap on the helmet. When wearing a cover shield, even in a strong wind, a cyclist is able to hear a vehicle approaching from the rear so that he can accordingly move close to the side of a roadway and ensure that his cycle moves in a straight, unswerving path.

6 Claims, 1 Drawing Sheet

EAR WIND SHIELD

FIELD OF THE INVENTION

This invention relates to cyclist safety accessories. More particularly this invention relates to an ear wind shield for cyclists. An ear wind shield alleviates wind roar and allows cyclists to perceive rearwardly approaching passing motor vehicles which would otherwise be imperceptible.

BACKGROUND OF THE INVENTION

The inventor is an avid cyclist. Frequently he has been startled when motor vehicles have appeared two feet from the side of his bicycle. They have overtaken him from the rear. He has not seen them approaching. He has at times failed to hear even large trucks approaching. If he was aware that he was almost in the path of these potentially deadly vehicles, he would have moved over closer to the edge of the roadway. He would definitely have focused to a larger degree on maintaining his bicycle on a straighter course. But he could not see them coming; and because of wind noise, he could not hear them approaching.

When riding into a head wind, or on a fast descent, or when leading a break in bike racing, wind roar entirely blankets out all other sound. Most cyclists forget this in the roar and heat of the moment. They ride along their usual path, along a no straighter path than usual. They are oblivious to a close by overtaking vehicle—which they haven't perceived. They are somewhat startled when they see the motor vehicle within an arm's length from them. They didn't realize that the vehicle could immediately appear so closely without warning. They completely failed to perceive its approach.

OBJECTS OF THE INVENTION

It is an object of this invention to disclose an ear wind shield for cyclists so that they can hear proximate noise which they normally would hear, and which they expect to hear. It is an object of this invention to improve cycling safety by facilitating the perception of normal road noise when a wind is rushing over and around a cyclist. It is yet a further object of this invention to draw attention to a problem which is generally unperceived as a problem; and finally to disclose a simple and effective solution to that problem.

One aspect of this invention provides for a method of alleviating the sound masking effects of wind noise on a cyclist comprising the steps of: designing an ear cover shield having a generally smooth exterior side; positioning the cover shield adjacent to but generally spaced from an ear of the cyclist so that wind is generally deflected from the ear so that the noise of air rushing over the ear is substantially reduced, and the cyclist is better able to hear proximate sound—especially that sound generated from directions which he cannot readily see; and, employing position maintenance means to hold the shield in position with respect to the ear.

A preferred aspect of this invention comprises a method which is only applicable when a cyclist is wearing a safety helmet. In this preferred method the position maintenance means comprisess a strap on the bicycle safety helmet.

Various other objects, advantages and features of this invention will become apparent to those skilled in the art from the following description in conjunction with the accompanying drawings.

FIGURES OF THE INVENTION

Figure 1:
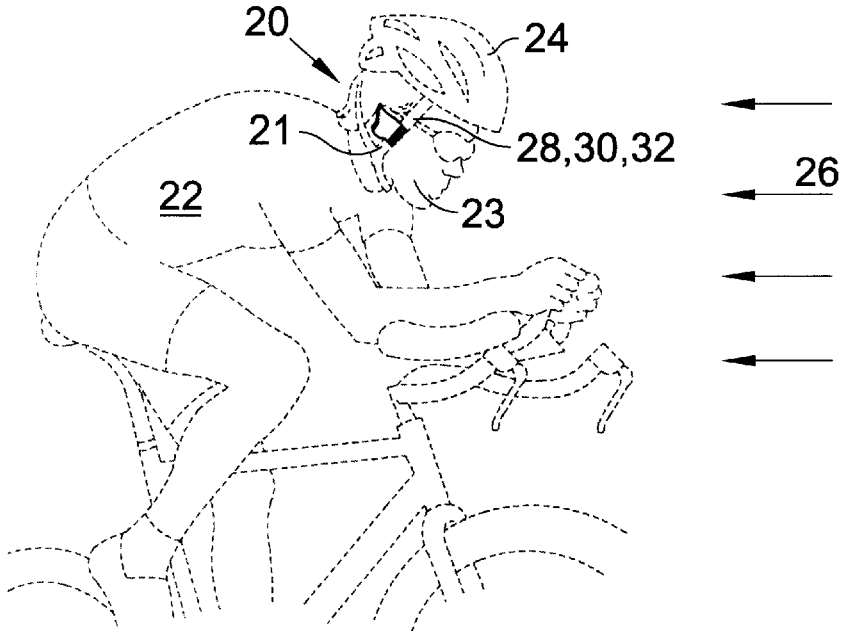
FIG. 1 is a perspective view of a cyclist wearing a bicycle safety helmet carrying an ear wind shield.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a cyclist 22 wearing a bicycle safety helmet 24 carrying an ear wind shield 20. A method of alleviating the sound masking effects of wind 26 noise on a cyclist 22 comprises the following steps of: designing an ear cover shield 20 having a generally smooth exterior side; and secondly, positioning the cover shield adjacent to, but generally spaced from an ear 21 of the cyclist 22 so that wind 26 is generally deflected from the ear 21 so that the noise of air rushing over the ear 21 is substantially reduced, and the cyclist 22 is better able to hear proximate sound, especially that sound generated from directions which he cannot readily see. Finally, position maintenance means 28 is employed to hold the shield 20 in position with respect to the ear 21.

The position maintenance means 28 may comprise a member 30 which carries the cover shield 20 and extends downwardly adjacent to the head 23 towards the ear 21. Usually a cyclist wears a safety helmet 24 and the position maintenance means 28 most preferably may then comprise a strap 32 on the helmet 24. The downwardly extending member 30 is configured to remain in a relatively constant position with respect the helmet 24 when secured on a cyclist's head 23.

Most preferably the cover shield 20 is adjustably secured to the strap 32 by a front portion of the cover shield 20 so that it may be shifted along the strap 32 to be optimally positioned for a particular cyclist 22. In the most preferred embodiment of the invention the cover shield 20 is secured to the strap 32 by a hook and fabric type fastener 34.

It is contemplated that in an alternative embodiment of the invention (not shown) the member 30 which extends downwardly from the helmet 24 carrying the cover shield 20 would comprise a generally rigid, but inwardly biased arm.

Figure 2:
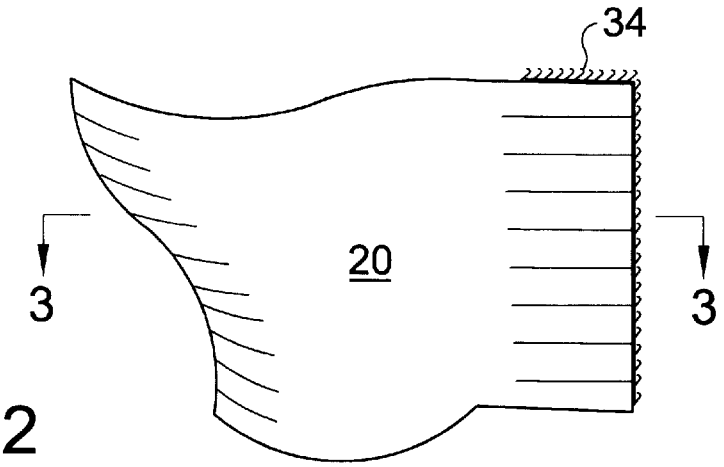
FIG. 2 is a perspective view of the ear wind shield shown in FIG. 1.
Figure 3:
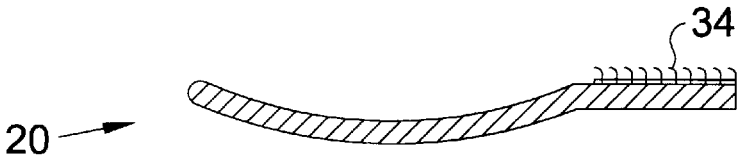
FIG. 3 is a cross sectional view taken along line 3—3 in FIG. 2 of the ear wind shield.

FIG. 2 is a perspective view of the ear wind shield 20 shown in FIG. 1. Most preferably the cover shield 20 is configured to resemble a wing for aesthetic reasons. FIG. 3 is a cross sectional view taken along line 3—3 in FIG. 2 of the ear wind shield 20. The cover shield 20 is made of molded plastic. The cover shield 20 has a somewhat concave contour on a side thereof adjacent to the ear 21.

While the invention has been described with preferred specific embodiments thereof, it will be understood that this description is intended to illustrate and not to limit the scope of the invention, which is defined by the following claims.

I claim:

1. A method of alleviating the sound masking effects of wind noise on a cyclist wearing a helmet having a downwardly extending strap comprising the following steps:

designing an ear cover shield having a generally smooth exterior side;

positioning the cover shield adjacent to, but generally spaced from an ear of the cyclist so that wind is generally deflected from the ear so that the noise of air rushing over the ear is substantially reduced, and the cyclist is better able to hear proximate sound especially that sound generated from directions which he cannot readily see; and, securing a front portion of the cover shield to the strap on the helmet so that ear shield is automatically and correctly maintained in a relatively constant spaced position adjacent to and beneath the helmet with respect to the ear, each time the helmet is worn by the cyclist.

2. A method as in claim 1 wherein the cover shield is adjustably secured to the strap so that it may be shifted therealong to be optimally positioned for a particular cyclist.

3. A method as in claim 1 wherein the cover shield is configured to resemble a wing for aesthetic reasons.

4. A method as in claim 2 wherein the cover shield is secured to the strap by a fastener comprising hooks and fabric.

5. A method as in claim 1 wherein the cover shield is molded from plastic.

6. A method as in claim 5 wherein the cover shield has a generally concave contour on a side thereof adjacent to the ear.

* * * * *